US006409295B1

(12) United States Patent
Norigoe

(10) Patent No.: US 6,409,295 B1
(45) Date of Patent: Jun. 25, 2002

(54) INK-JET DEVICE

(75) Inventor: Takashi Norigoe, Shizuoka-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/239,434

(22) Filed: Jan. 28, 1999

(30) Foreign Application Priority Data

Feb. 2, 1998 (JP) ..... 10-020675

(51) Int. Cl.[7] ..... B41J 29/38; B41J 2/205
(52) U.S. Cl. ..... 347/11; 9/10; 9/15
(58) Field of Search ..... 347/9–11, 15

(56) References Cited

U.S. PATENT DOCUMENTS 4,251,824 A * 2/1981 Hara et al. ..... 347/57
4,513,299 A * 4/1985 Lee et al. ..... 347/15
5,285,215 A 2/1994 Liker ..... 347/11
5,689,291 A * 11/1997 Tence et al. ..... 347/10
6,126,263 A * 10/2000 Hotoni et al. ..... 347/15

* cited by examiner

*Primary Examiner*—John Barlow
*Assistant Examiner*—Alfred E Dudding
(74) *Attorney, Agent, or Firm*—Frishauf, Holtz, Goodman & Chick, P.C.

(57) ABSTRACT

An ink-jet device is composed of a print head for ejecting ink as drops from an ink chamber to print a dot at a tone-level corresponding to an amount of ejected ink, and a drive unit for driving the print head by successively supplying a variable number of drive pulses each of which allows the ink chamber to generate pressure of ejecting a single drop of ink. Particularly, the drive unit includes a drive IC for generating a fixed number of drive pulses and shortening the supply cycle of the drive pulses such that the pressure of the ink chamber is gradually increased to finally eject a drop of ink when the dot is printed in monotone.

3 Claims, 8 Drawing Sheets

INK-JET DEVICE

BACKGROUND OF THE INVENTION

The present invention relates to an ink-jet device capable of printing dots in tones and, more particularly, to a multi-drop driving ink-jet device in which the tone-level of each dot is determined by the amount of ink successively ejected as drops from a print head.

In a conventional ink-jet printer, a print head comprises a plurality of ink chambers separated from each other by partition walls formed of, e.g., electrostrictive members, and an orifice plate which covers the distal ends of the ink chambers and has a plurality of ink-jet nozzles. Ink in the ink chambers is ejected from the ink-jet nozzles by pressures applied upon deformation of the partition walls. Each partition wall deforms in accordance with the waveform of a drive pulse applied via an electrode. The waveform of the drive pulse is set to deform the partition wall in a predetermined sequence of causing the ink chamber to be temporarily expanded, then contracted, and returned to an original state.

In a multi-drop driving scheme, each ink-jet nozzle prints one dot by successively ejecting ink drops equal in number to the number of drive pulses supplied to the electrode. If there is no change in the waveform of the drive pulse, the tone-level of the dot increases almost in proportion to the number of ink drops.

When a dot pattern of a character or simple graphic is to be printed in monotone where no difference exists between the tone-levels of dots, a conventional multi-drop driving ink-jet printer generally prints all dots at the maximum tone-level in order to obtain a dot diameter which allows the dots to be adjacent to each other without any gap. In this case, drive pulses in the maximum number are successively supplied to an electrode, and ink drops in the maximum number are ejected from an ink-jet nozzle upon mechanical deformation of partition walls controlled by the drive pulse.

However, monotone printing is performed substantially in the same driving manner as for multi-tone printing, so the above ink-jet printer is inferior to an ink-jet printer dedicated for monotone printing in terms of the print speed. At the time of monotone printing, the number of ink ejecting motions may be reduced by, e.g., increasing the amplitude of the drive pulse to enlarge the ink drop. This requires a high drive ability of the drive pulse source.

BRIEF SUMMARY OF THE INVENTION

It is an object of the present invention to provide an ink-jet device capable of performing monotone printing at a higher speed than for multi-tone printing without changing the drive ability of a drive pulse source in a multi-drop driving scheme.

According to the present invention, there is provided an ink-jet device which comprises a print head for ejecting ink as drops from an ink chamber to print a dot at a tone-level corresponding to an amount of ejected ink, and a drive unit for driving the print head by successively supplying a variable number of drive pulses each of which allows the ink chamber to generate pressure of ejecting a single drop of ink, wherein the drive unit includes a pulse generator for generating a fixed number of drive pulses and shortening the supply cycle of the drive pulses such that the pressure of the ink chamber is gradually increased to finally eject a drop of ink when the dot is printed in monotone.

With the ink-jet device, when a dot is printed in monotone, a single drop of ink is ejected from the ink chamber by shortening the supply cycle of the drive pulses. In this case, the dot can be printed in excellent contrast without requiring a longer period of time as compared with the case where a plurality of ink drops are ejected. In addition, such shortening of the supply cycle does not require an increase in the drive ability of the pulse generator.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

An ink-jet device according to an embodiment of the present invention will be described below with reference to the accompanying drawings.

Figure 1:
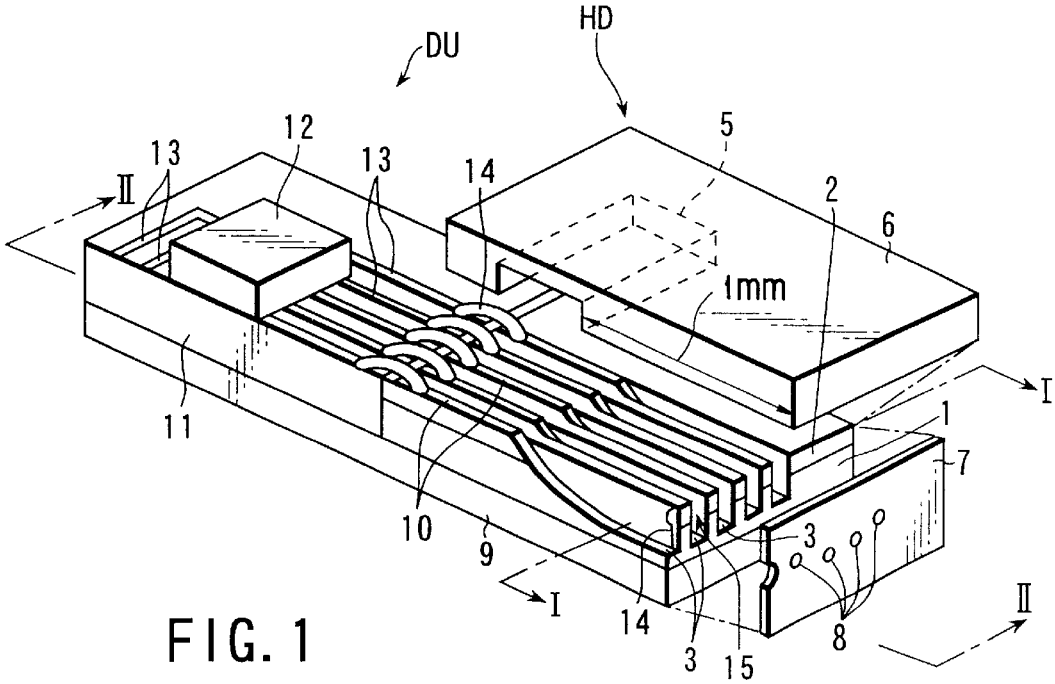
FIG. 1 is a partial exploded perspective view showing the structure of an ink-jet device according to an embodiment of the present invention.
Figure 2:
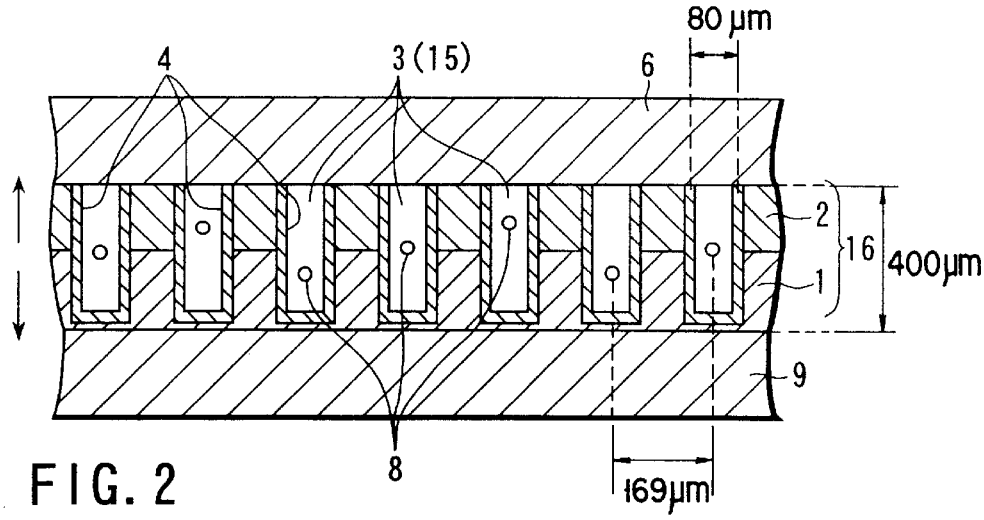
FIG. 2 is a sectional view of the ink-jet device taken along the line II—II shown in FIG. 1.
Figure 3:
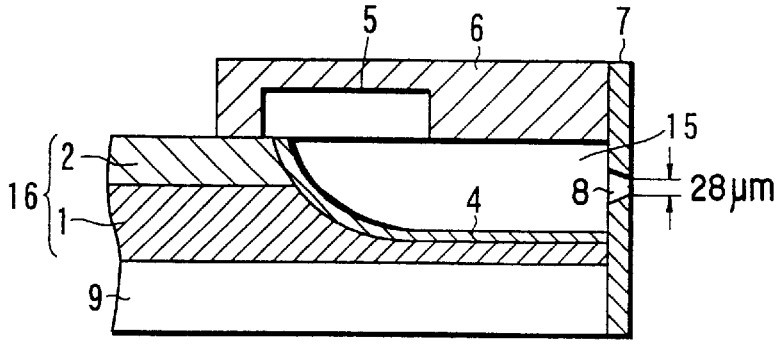
FIG. 3 is a sectional view of the ink-jet device taken along the line III—III shown in FIG. 1.

FIG. 1 shows the structure of the ink-jet device. FIG. 2 shows a section of the ink-jet device taken along the line II—II shown in FIG. 1. FIG. 3 shows a section of the ink-jet device taken along the line III—III shown in FIG. 1. This ink-jet device comprises a share mode type line print head HD, a drive unit DU driving for the line print head HD, and a support plate 9 for supporting the print head HD and drive unit DU. The print head HD is constituted by two plate-like electrostrictive members 1 and 2 which are polarized in opposite directions as indicated by arrows in FIG. 2 and bonded to each other, and respectively fixed to the support plate 9 and a top plate 6. The electrostrictive members 1 and 2 are cut in advance from the electrostrictive member 2 side to have a plurality of parallel grooves 3 formed with a slope gradually shallower toward the proximal end, as shown in FIG. 1. The print head HD includes a plurality of drive electrodes 4 covering the entire inner surfaces of these grooves 3 and lead electrodes 10 each made of an electroless-plating conductive film and extending from the drive electrodes 4 to the backside of the grooves 3. These grooves 3 form a plurality of ink chambers 15 which are separated from each other by partition walls 16 made of the electrostrictive members 1 and 2 and are covered with the top plate 6. The top plate 6 has an ink storage 5 which communicates with these ink chambers 15 and is laid out at the backside of the grooves 3. The ink chambers 15 are further closed by an orifice plate 7 disposed at the distal end. This orifice plate has a plurality of ink-jet nozzles 8 each for ejecting ink in the ink chamber 15. The drive unit DU comprises a printed wiring board 11 adhered to the support plate 9 and a drive IC 12 mounted on the printed wiring board 11. The printed wiring board 11 has a wiring pattern 13 formed to wire the drive IC 12. The plurality of electrodes 4 are connected to the wiring pattern 13 via bonding wires 14. The support plate 9 is either a conductor or insulator, and may be made of the same material as that of, e.g., the electrostrictive members 1 and 2.

The drive unit DU drives all the ink chambers 15 by, e.g., a three-divisional driving scheme. In the share mode type line print head HD, all the ink chambers are divided into three groups because an ink chamber 15 cannot be driven at the same time as two adjacent ink chambers 15 sharing partition walls 16. In this case, the first group (n) includes the first, fourth, seventh, . . . ink chambers 15, the second group (n+1) includes the second, fifth, eighth, . . . ink chambers 15, and the third group (n+2) includes the third, sixth, ninth, . . . ink chambers 15. The first, second, and third groups of ink chambers 15 are driven at timings different from each other.

The ink ejection principle of the above-mentioned ink-jet device will be explained.

Figure 4A:
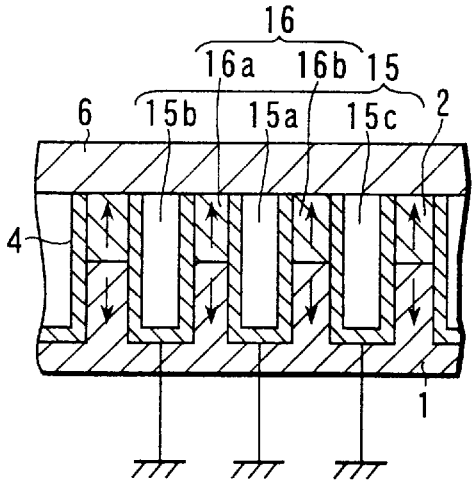
FIGS. 4A to 4D are sectional views showing a sequence of deforming partition walls shown in FIG. 1.

As shown in FIG. 4A, while the electrodes 4 of an ink chamber 15*a* and two adjacent ink chambers 15*b* and 15*c* are grounded, partition walls 16*a* and 16*b* respectively sandwiched between the ink chambers 15*a* and 15*b* and the ink chambers 15*a* and 15*c* do not receive any deformation action, and thus the ink chamber 15*a* is in a steady state.

Figure 4B:
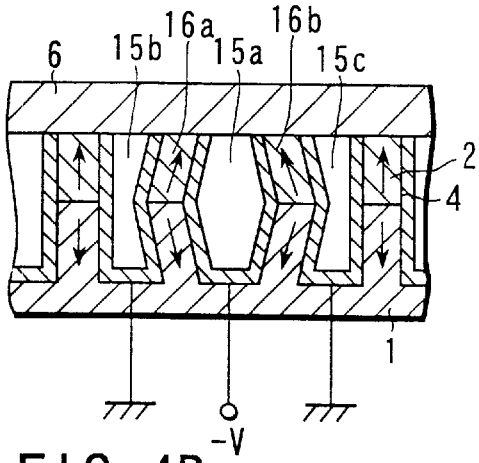

As shown in FIG. 4B, if a negative voltage −V is applied to the electrode 4 of the ink chamber 15*a* in this state for only a time T1 while grounding the electrodes 4 of the ink chambers 15*b* and 15*c*, an electric field acts on the partition walls 16*a* and 16*b* in a direction perpendicular to the polarization directions of the electrostrictive members 1 and 2. Then, the partition walls 16*a* and 16*b* deform outward so as to increase the volume of the ink chamber 15*a*. This deformation decreases the internal pressure of the ink chamber 15*a* to receive ink from the common ink storage 5.

Figure 4C:
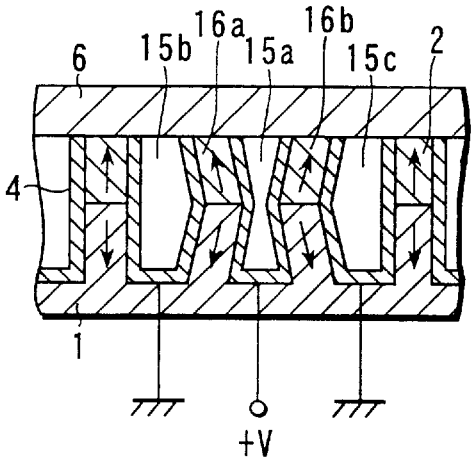
Figure 4D:
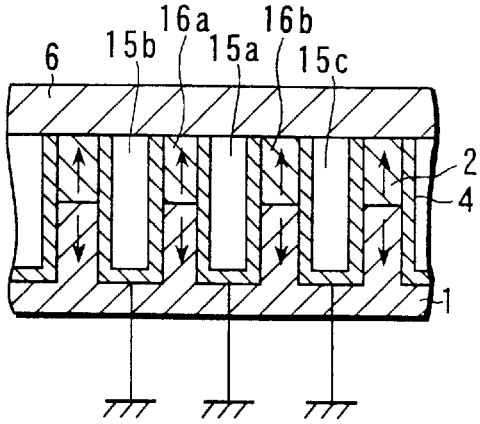

As shown in FIG. 4C, if a positive voltage +V is applied to the electrode 4 of the ink chamber 15*a* for only a time T2 while grounding the electrodes 4 of the ink chambers 15*b* and 15*c*, an electric field acts on the partition walls 16*a* and 16*b* in a direction which is perpendicular to the polarization directions of the electrostrictive members 1 and 2 but opposite to the previous direction. Accordingly, the partition walls 16*a* and 16*b* deform inward so as to decrease the volume of the ink chamber 15*a*. This deformation increases the internal pressure of the ink chamber 15*a* to eject ink from the ink-jet nozzle 8 of the ink chamber 15*a*. As shown in FIG. 4D, the electrode 4 of the ink chamber 15*a* is grounded again to return the ink chamber 15*a* to the original steady state.

Figure 5:
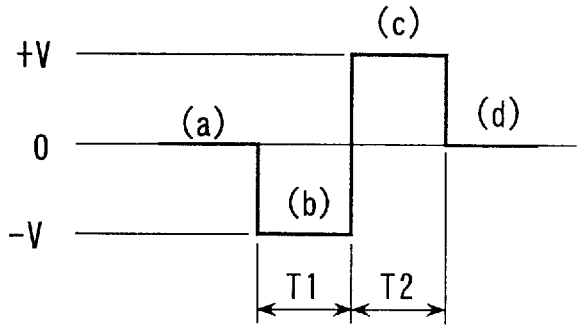
FIG. 5 is a waveform chart showing the waveform of a drive pulse for causing the partition walls to be deformed in the sequence shown in FIGS. 4A to 4D.

FIG. 5 shows the waveform of a drive pulse for causing the partition walls 16*a* and 16*b* to be deformed in the sequence shown in FIGS. 4A to 4D. In FIG. 5, potentials (a) to (d) respectively correspond to the states shown in FIGS. 4A to 4D. A plurality of drive pulses of the waveform can be successively supplied to the drive unit DU to eject a plurality of ink drops from the ink-jet nozzle 8 of the ink chamber 15*a*.

Figure 6:
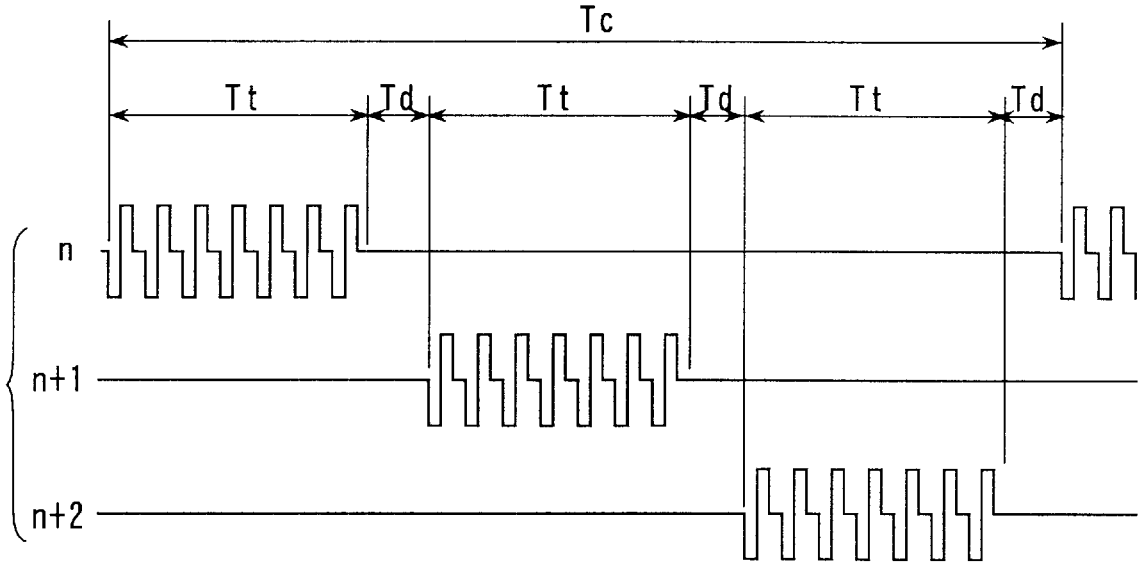
FIG. 6 is a timing chart showing seven drive pulses supplied to each of three adjacent electrodes shown in FIG. 2 in order to print dots of the maximum tone-level in a multi-tone print mode.
Figure 7:
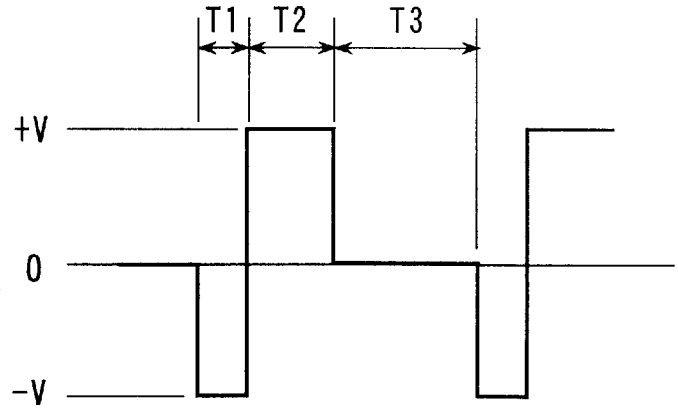
FIG. 7 is a timing chart showing timings of changing the voltage of the drive pulse shown in FIG. 6.

The above ink-jet device operates as follows in a multi-tone print mode. FIG. 6 shows seven drive pulses supplied to each of three adjacent electrodes 4 in order to print a dot of the seventh tone-level as the maximum tone-level in the multi-tone print mode. FIG. 7 shows timings of changing the voltage of each drive pulse shown in FIG. 6. The drive pulse has such a waveform that after the negative voltage −V is applied for only the time T1 (=2.5 μs), the voltage is switched to the positive voltage +V and applied for only the time T2 (=4.6 μs), and a voltage of 0V is applied for only a time T3 (=5.7 μs). That is, one drive pulse has a time width Tt=T1+T2+T3. To print a dot of the maximum tone-level, a drive pulse having this waveform is supplied seven times. When the group of ink chambers 15 is switched with a delay time Td, a cycle time Tc necessary for three-divisional driving is Tc=(T1+T2+T3)×7×3+Td×3=Tt×7×3+Td×3, and the drive frequency is its reciprocal.

Figure 8A:
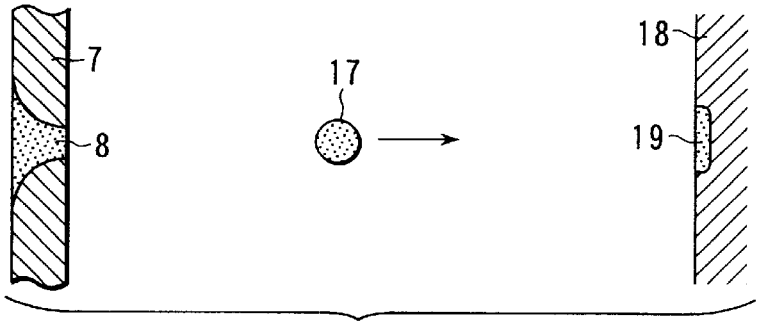
FIGS. 8A to 8C are views showing the states of ejecting different numbers of ink drops from the ink-jet nozzle shown in FIG. 1 in the multi-tone print mode.
Figure 8B:
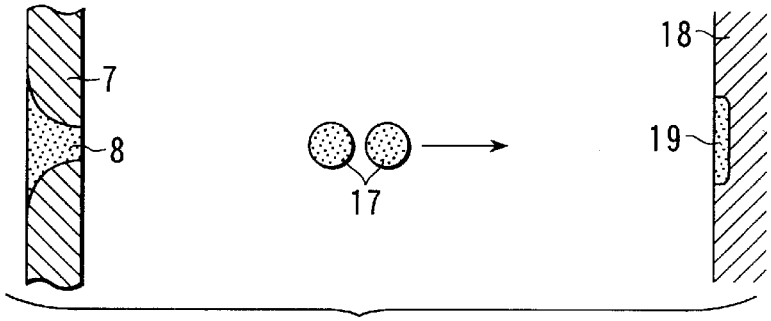
Figure 8C:
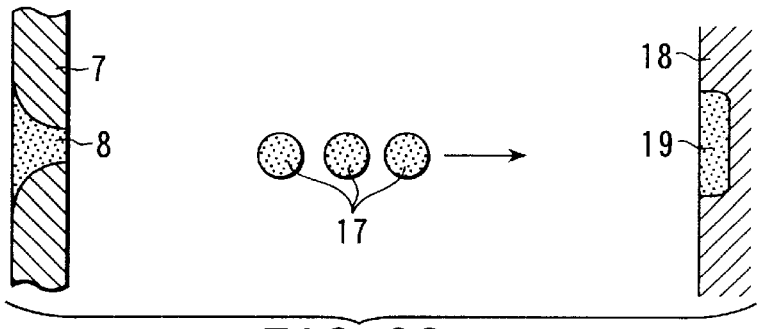
Figure 9:
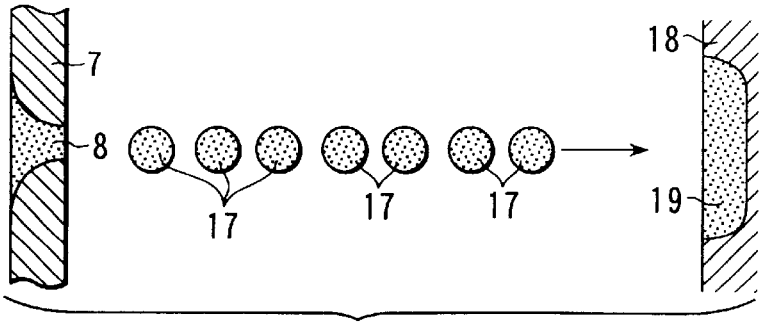
FIG. 9 is a view showing the state of ejecting seven ink drops in order to print a dot of the maximum tone-level in the multi-tone print mode.

FIGS. 8A to 8C show the states in which different numbers of ink drops are ejected from the ink-jet nozzle shown in FIG. 1 in the multi-tone print mode. FIG. 9 shows the state in which seven ink drops are ejected to print a dot of the maximum tone-level in the multi-tone print mode. A dot 19 is formed when an ink drop 17 which has been ejected from the ink-jet nozzle 8 and reached a recording sheet 18 penetrates the recording sheet 18.

When a dot of the first tone-level is to be printed, one ink drop is ejected from the ink-jet nozzle 8, as shown in FIG. 8A. In this case, the ink amount penetrating the recording sheet 18 is small, and the smallest dot 19 is formed.

When a dot of the second tone-level is to be printed, two ink drops 17 are ejected from the ink-jet nozzle 8, as shown in FIG. 8B. The ink amount penetrating the recording sheet 18 is substantially double the ink amount when one ink drop 17 is ejected, and thus the dot diameter is larger.

When a dot of the third tone-level is to be printed, three ink drops 17 are ejected from the ink-jet nozzle 8, as shown in FIG. 8C. The dot diameter is much larger.

When a dot of the maximum tone-level is to be printed, seven ink drops 17 are ejected from the ink-jet nozzle 8, as shown in FIG. 9. A dot 19 having the largest dot diameter is formed on the recording sheet 18.

Although dots of the fourth to sixth tone-levels are not illustrated, the number of ink drops increases in accordance with the tone-level, and the ink amount penetrating the recording sheet 18 also increases accordingly. In multi-drop driving, the print density linearly varies with the number of ejected ink drops. Therefore, high-quality tone printing can be realized by controlling the number of ink drops ejected by drive pulses.

Figure 10:
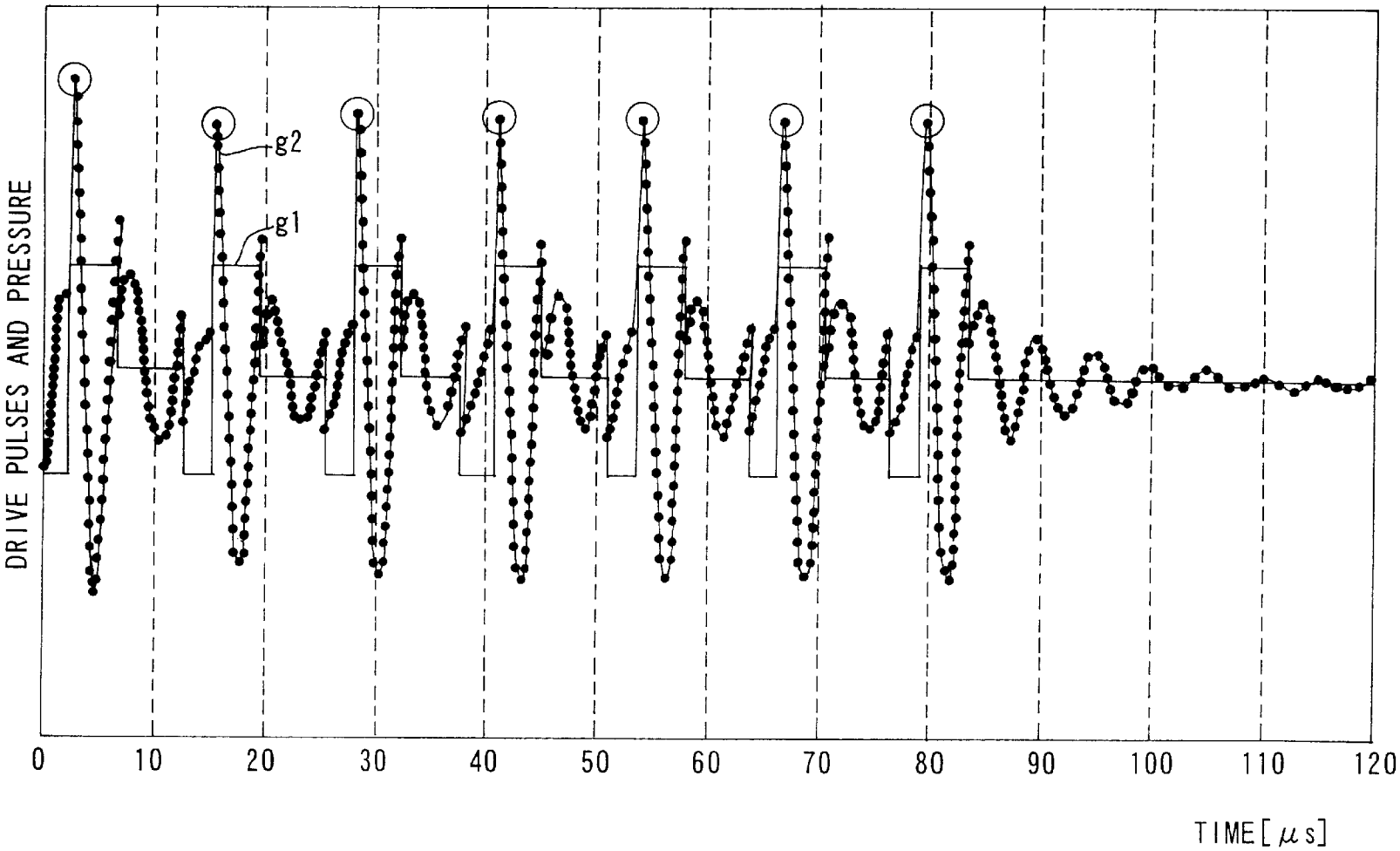
FIG. 10 is a graph showing the relationship between the waveform of seven drive pulses supplied for printing shown in FIG. 9 and an average ink chamber pressure.

FIG. 10 shows the relationship between the waveform of seven drive pulses g1 supplied for printing in FIG. 9 and an average ink chamber pressure g2. In driving, the average ink chamber pressure g2 is set substantially at a constant level for second to seventh drops except for the first drop, as indicated by circles in FIG. 10. The pressure for the first drop is set slightly higher than that for the second drop in consideration that the ink ejection speed of the first drop is lower than of the second drop.

In the above-described multi-tone print mode, each ink drop is substantially ejected at a predetermined ejection speed and a predetermined amount regardless of the difference in tone-level. High-quality tone printing is therefore performed by linearly changing the tone-level of the dot in accordance with the number of ink drops. When only a dot of the maximum tone-level is to be printed in this multi-drop driving scheme, the ejection speed and amount of each ink drop are kept almost constant in order to deform the partition wall 16 in the predetermined sequence.

Figure 11:
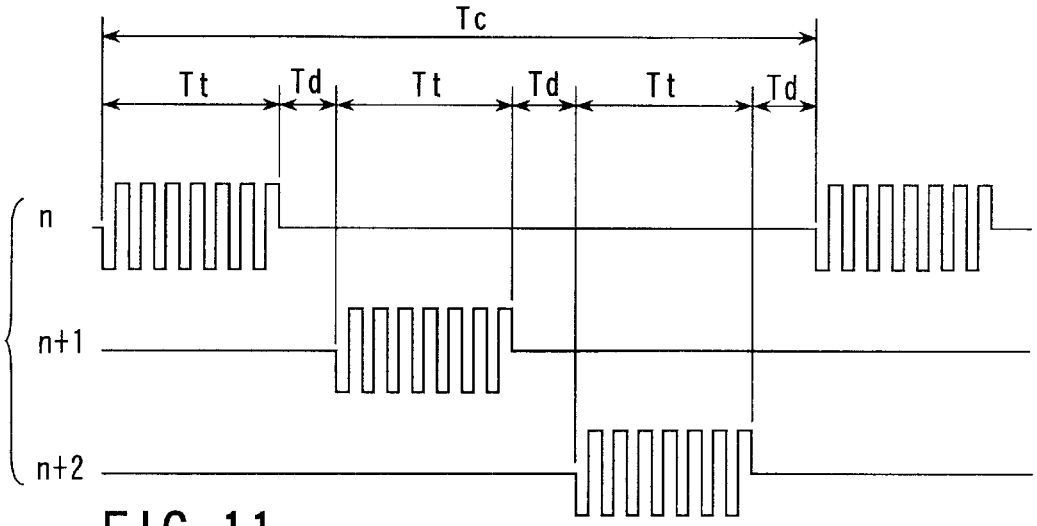
FIG. 11 is a timing chart showing seven drive pulses supplied to each of three adjacent electrodes shown in FIG. 2 in order to print a dot of the maximum tone-level in a monotone print mode.
Figure 12:
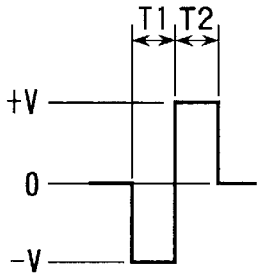
FIG. 12 is a timing chart showing timings of changing the voltage of the drive pulse shown in FIG. 11.
Figure 13:
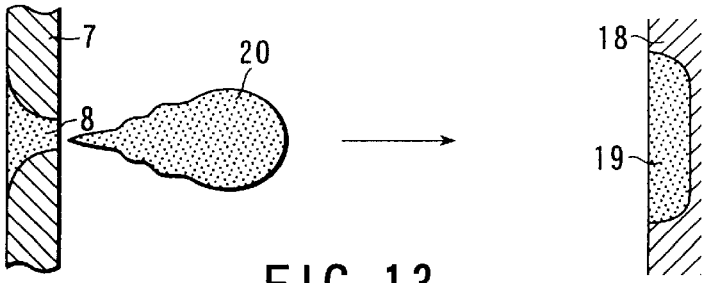
FIG. 13 is a view showing the state of ejecting a single ink drop in order to print a dot of the maximum tone-level in the monotone print mode.

The above ink-jet device operates as follows in a monotone print mode. FIG. 11 shows seven drive pulses supplied to each of three adjacent electrodes 4 in order to print a dot of the maximum tone-level in a monotone print mode. FIG. 12 shows timings of changing the voltage of each drive pulse shown in FIG. 11. The drive pulse has such a waveform that the negative voltage −V is applied for only the time T1 (=2.5 μs) and then the positive voltage +V is applied for only the time T2 (=2.5 μs). To print a dot of the maximum tone-level, a drive pulse having this waveform is supplied seven times, similar to the multi-tone print mode. In this case, seven ink drops do not separately travel from the ink-jet nozzle 8, unlike the multi-tone print mode. Alternatively, a single ink drop 20 greatly expands at the ink-jet nozzle 8 and then travels, as shown in FIG. 13. FIG. 13 shows an example in which a single ink drop 20 travels, but two or three ink drops 20 may separately travel depending on conditions such as the values of the times T1 and T2 and changes in physical ink properties by the temperature.

More specifically, in the monotone print mode, the amplitude of a pressure wave generated by deformation of the partition wall is gradually amplified in the ink chamber. For this reason, the drive pulse times T1 and T2 are set to a time AL required for the pressure wave to propagate through a propagation distance from one end to the other end of the ink chamber 15. Strictly speaking, this propagation distance is equal to a distance from the end position of the ink storage 5 to the position of the ink-jet nozzle 8. If the drive pulse times T1 and T2 are set in this way, a larger ink drop can be ejected with a smaller energy.

Figure 14:
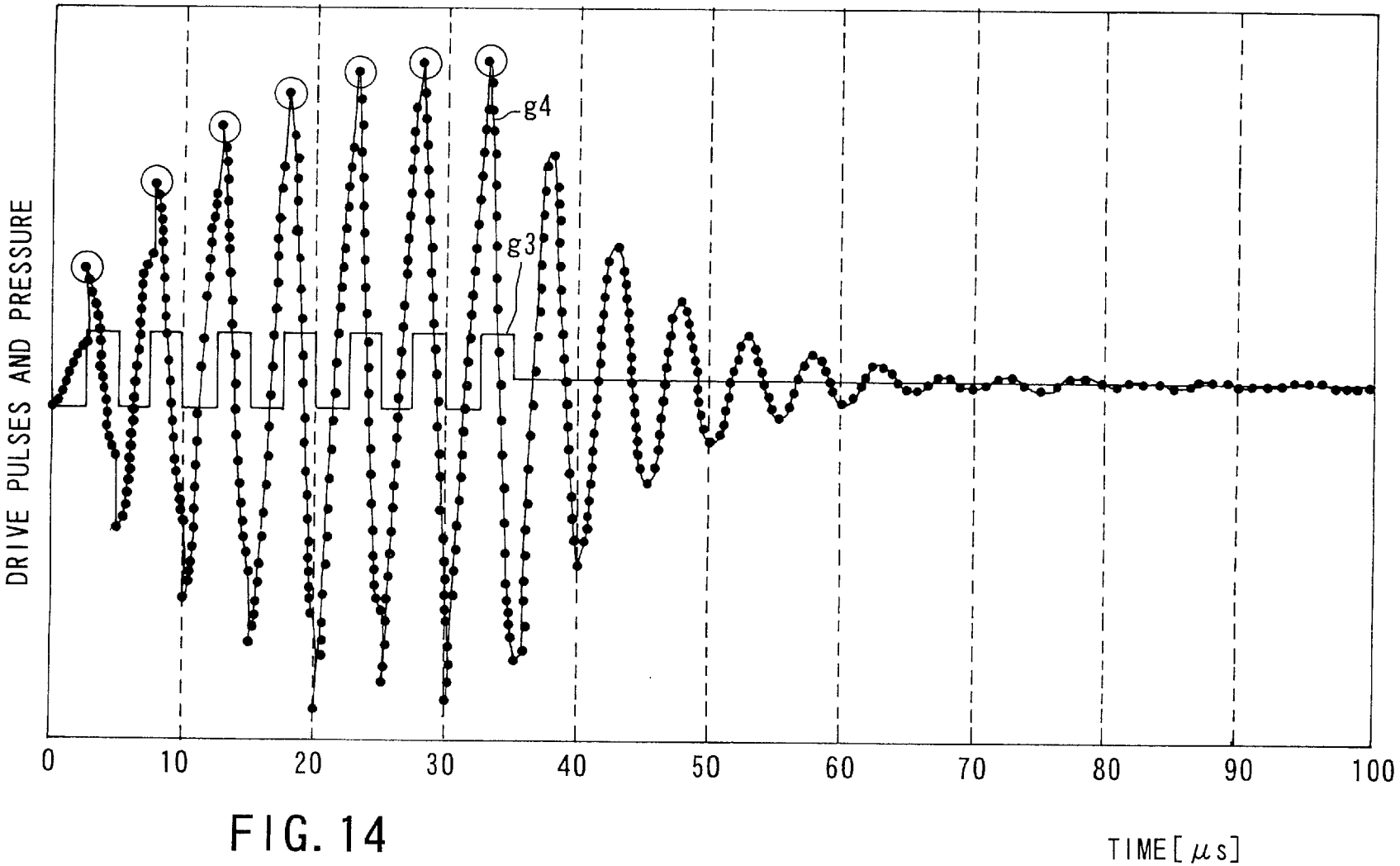
FIG. 14 is a graph showing the relationship between the waveform of seven drive pulses supplied for printing shown in FIG. 13 and an average ink chamber pressure.

FIG. 14 shows the relationship between the waveform of seven drive pulses g3 supplied for printing in FIG. 13 and an average ink chamber pressure g4. In driving, the average ink chamber pressure g4 gradually increases, as indicated by circles in FIG. 14. The pressure for the first drop is small not to eject the first drop. As operation progresses to the second and third drops, the pressure increases, ink drops to be ejected from the ink-jet nozzle 8 form one large mass, which travels and reaches the recording sheet 18.

As described above, in the monotone print mode, the time T3 can be zero, the time T2 is shorter, and the time T1 is equal or shorter, and thus the total time width of the drive pulse becomes much shorter, compared to the drive pulse in the multi-tone print mode. The drive frequency per dot can increase to increase the print speed.

More specifically, in the multi-tone print mode shown in FIG. 10, since T1, T2, and T3 in one drive pulse are 2.5 μs, 4.6 μs, and 5.7 μs, respectively, the time width Tt of one drive pulse is Tt=(2.5+4.6+5.7)×7=89.6 μs. With a delay time Td of 30 μs for switching the ink chamber 15, the cycle time Tc necessary for three-divisional driving is Tc=(89.6+30)×3=358.8 μs, and the drive frequency F per dot is F=1/Tc=2787 Hz.

To the contrary, in the monotone print mode shown in FIG. 14, since T1=T2=AL=2.5 μs holds in one drive pulse, the time width Tt of one drive pulse is Tt=(2.5+2.5)×7=35 μs. With a delay time Td of 30 μs between groups, the cycle time Tc necessary for three-divisional driving is Tc=(35+30)×3=195 μs, and the drive frequency F per dot is F=1/Tc=5128 Hz, which is much higher than in the multi-tone print mode.

In the above embodiment, the drive pulse in the monotone print mode has such a waveform that the negative voltage −V is applied for only the time T1 and then the positive voltage +V is applied for only the time T2. However, the drive pulse is not limited to this waveform, and may have the same waveform as that in the multi-tone print mode. Note that the times T1, T2, and T3 must be set to gradually increase the pressure of the ink chamber.

Figure 15:
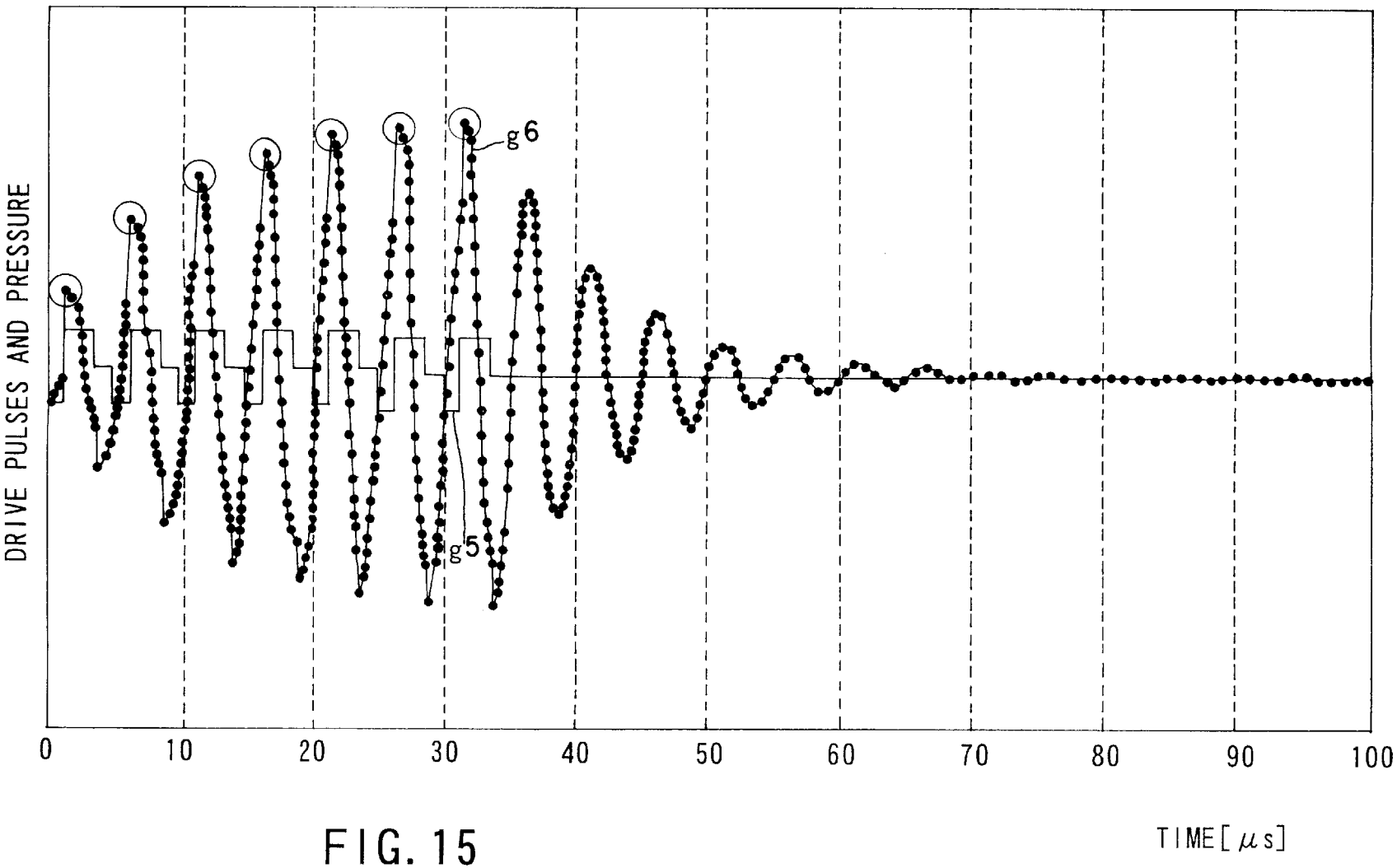
FIG. 15 is a graph showing the relationship between the waveform of drive pulses and an average ink chamber pressure obtained when the supply cycle of seven drive pulses shown in FIG. 10 is shortened for the monotone print mode.

FIG. 15 shows the relationship between the waveform of drive pulses g5 and an average ink chamber pressure g6 obtained when the supply cycle of seven drive pulses g3 shown in FIG. 10 is shortened for the monotone print mode. In this case, the waveform of the drive pulse g5 is set to T1=1.25 μs, T2=2.5 μs, and T3=1.25 μs. Even with a drive pulse having the same waveform as that in the multi-tone print mode, the pressure of the ink chamber upon driving gradually increases, as indicated by circles in FIG. 15. In this case, the cycle time Tc necessary for three-divisional driving is Tc=(35+30)×3=195 μs, similar to the above embodiment. The drive frequency F per dot is F=1/Tc=5128 Hz, which is much higher than in the multi-tone print mode.

In this manner, even when a drive pulse having the same waveform as that in the multi-tone print mode is used, if the drive pulse is set to gradually increase the internal pressure of the ink chamber, the drive frequency per dot can be increased to increase the print speed, as in the aforementioned embodiment.

The above embodiment has exemplified an application of the present invention to a share mode type ink-jet line print head, but the present invention is not limited to this. For example, the present invention can also be applied to an ink-jet line print head in which an electrostrictive member is arranged in one or both of the upper and lower sides of the ink chamber, an ink-jet line print head using no electrostrictive member, and a serial printer in addition to a line printer. That is, the present invention is applicable to a multi-drop driving ink-jet print head which comprises a drive portion for changing the pressure of the ink chamber in accordance with the drive pulse, and controls the number of drive pulses supplied to the drive portion to change the number of ink drops ejected from the ink chamber, thereby performing multi-tone printing.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An ink-jet device comprising:

a print head having an ink chamber which stores ink to be ejected therefrom and an electrostrictive member which deforms the ink chamber to increase a pressure of said ink chamber to eject the ink; and a drive unit which drives said print head such that said ink is ejected as one or more ink drops in a multi-tone print mode and as a single ink drop in a monotone print mode;

wherein said drive unit includes a pulse generator which: (i) supplies a variable number of drive pulses to said print head in a first cycle so as to cause the ink chamber to successively eject a number of ink drops equal to the variable number of drive pulses in the multi-tone print mode, and (ii) supplies a fixed number of drive pulses to said print head in a second cycle shorter than the first cycle so as to cause the pressure of said ink chamber to be gradually increased to finally eject the single ink drop in the monotone print mode; and wherein an amplitude of the drive pulses is constant between the multi-tone print mode and the monotone print mode.

2. An ink-jet device according to claim 1, wherein said pulse generator is arranged to produce, as the fixed number of drive pulses, a series of pulses each of which has a waveform to be changed to a first level for obtaining a negative pressure state of said ink chamber and to a second level for obtaining a positive pressure state of said ink chamber.

3. An ink-jet device according to claim 2, wherein said pulse generator is arranged to produce the series of pulses such that a duration of each of the first and second levels is set equal to a time required for a pressure wave to propagate through a propagation distance from a first end of said ink chamber to a second end of said ink chamber.

* * * * *